US006820565B1

(12) United States Patent
Kawaguchi et al.

(10) Patent No.: US 6,820,565 B1
(45) Date of Patent: Nov. 23, 2004

(54) EMBROIDERY SEWING MACHINE WITH EMBROIDERY FRAME TYPE DETECTING FUNCTION

(75) Inventors: Yasuhiko Kawaguchi, Nagoya (JP); Yasukazu Noguchi, Nagoya (JP); Masato Kato, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/784,272

(22) Filed: Feb. 24, 2004

(30) Foreign Application Priority Data

Feb. 27, 2003 (JP) ..... 2003-050439

(51) Int. Cl.[7] ..... D05B 21/00
(52) U.S. Cl. ..... 112/102.5
(58) Field of Search ..... 112/102.5, 103, 112/470.06, 475.19, 470.01; 700/138, 136, 137

(56) References Cited

U.S. PATENT DOCUMENTS 4,763,586 A * 8/1988 Takenoya et al. ..... 112/470.06
6,568,337 B1 * 5/2003 Durville ..... 112/102.5

FOREIGN PATENT DOCUMENTS

JP A 6-319880 11/1994
JP A 2002-52283 2/2002

* cited by examiner

*Primary Examiner*—Peter Nerbun
(74) *Attorney, Agent, or Firm*—Oliff & Berridge, PLC

(57) ABSTRACT

An embroidery sewing machine is disclosed in which a workpiece cloth is moved so that an embroidery pattern is formed on it. The embroidery sewing machine includes a plurality of types of embroidery frames differing in a size and/or a shape from each other and holding the workpiece cloth, the embroidery frames being selectively used, a carriage, a moving mechanism moving the carriage independently in two directions perpendicular to each other, a frame holder to which the embroidery frames are selectively attached, the frame holder including a holder body fixed to the carriage and a movable holder mounted to one of a plurality of positions corresponding to the respective types of the embroidery frames relative to the holder body so that the position of the movable holder is exchangeable, a detector detecting a position of the movable holder relative to the holder body, and a determining unit determining the type of the embroidery frame based on a result of detection by the detector.

15 Claims, 10 Drawing Sheets

EMBROIDERY SEWING MACHINE WITH EMBROIDERY FRAME TYPE DETECTING FUNCTION

BACKGROUND OF THE INVENTION

1. Field of the Invention

This invention relates to an embroidery sewing machine to which one of a plurality of embroidery frames is exchangeably attached.

2. Description of the Related Art

There have conventionally been provided sewing machines to which one of a plurality of embroidery frames is exchangeably attached according to the size of a workpiece cloth or the area of a sewing region. In the sewing machines of this type, the type of an attached embroidery frame needs to be detected in order that an origin of the sewing region may be determined or the sewing region may be detected. For example, JP-A-6-319880 discloses a sewing machine comprising a rock arm extending downward from a distal end of a sewing arm and a retractable lever mounted on a lower end of the rock arm. In the disclosed sewing machine, the embroidery frame is moved in the positive and negative directions on the X-axis while an abutting portion provided on the lower end of the retractable lever is located within the attached embroidery frame, so that the abutting portion is caused to abut both front and rear of the embroidery frame. The size of the attached embroidery frame is detected on the basis of two locations of the abutting portion.

In the foregoing sewing machine, however, the embroidery frame is attached to the sewing machine and subsequently moved in the two X directions so that the type of the embroidery frame is detected. As a result, the detection of the embroidery frame type takes much time. Further, when the operator has attached an erroneous embroidery frame or an embroidery frame with a sewing region which does not correspond to embroidery data, the operator is informed of the error by means of an error message or the like after the embroidery frame has been attached and its type has been detected. The operator needs to detach the erroneous embroidery frame, rearrange the workpiece cloth onto a correct embroidery frame, and attach the correct embroidery frame to the sewing machine. Thus, replacement of embroidery frame results in waste of time and labor.

As another example, JF-A-2002-52283 discloses an embroidery sewing machine in which one of a plurality of embroidery frames is exchangeably attached to a carriage of an embroidery frame moving mechanism provided on the sewing bed. In the disclosed construction, each embroidery frame includes a connecting portion having concavo-convex patterns (presence or absence of projection) formed at three juxtaposed detecting positions respectively and peculiar to every type of embroidery frame, whereby a detected portion indicative of a type of the embroidery frame. On the other hand, three detecting switches (microswitches) are provided at the carriage side so as to correspond to the detecting positions respectively. The detecting switches detect the respective concavo-convex patterns (presence or absence of projections at respective detecting positions), whereby the type of the attached embroidery frame is determined. This construction, however, requires three detecting switches, thereby complicating the structure for detecting the type of the embroidery frame. Additionally, since the type of the embroidery frame is detected after the embroidery frame has been attached, loss of time also occurs when a wrong embroidery pattern has been attached.

SUMMARY OF THE INVENTION

Therefore, an object of the present invention is to provide an embroidery sewing machine which has a function of detecting the type of a n embroidery frame and which can detect the type of the embroidery frame in a shorter period of time and can reduce the lost time in attachment of a wrong embroidery frame.

The present invention provides an embroidery sewing machine in which a workpiece cloth is moved so that an embroidery pattern is formed thereon, the embroidery sewing machine comprising a plurality of types of embroidery frames differing in a size and/or a shape from each other and holding the workpiece cloth, the embroidery frames being selectively used, a carriage, a moving mechanism moving the carriage independently in two directions perpendicular to each other, a frame holder to which the embroidery frames are selectively attached, the frame holder including a holder body fixed to the carriage and a movable holder mounted to one of a plurality of positions corresponding to the respective types of the embroidery frames relative to the holder body so that the position of the movable holder is exchangeable, a detector detecting a position of the movable holder relative to the holder body, and a determining unit determining the type of the embroidery frame based on a result of detection by the detector.

Before attaching a desired embroidery frame to the frame holder, the operator changes the position of the movable holder relative to the holder body of the frame holder corresponding to the type of the embroidery frame. The position of the movable holder is then detected by the detector, and the type of the embroidery frame is determined by the determining unit. In this case, since the type of the embroidery frame is detected before the embroidery frame is attached to the frame holder, the detection of the type of the embroidery frame can be carried out in a shorter period of time. Further, when a wrong embroidery frame is to be attached to the frame holder, an alarm can be given before attachment. This can save a time required to replace the attached embroidery frame by a correct one and a time required to change workpiece cloths.

In a preferred form, the detector includes a detected body provided with a plurality of detected portions corresponding to the embroidery frames respectively and a detecting element detecting the detected portion of the detected body. As a result, the arrangement of the detector can be simplified. In this case, the detected body is mounted on the movable holder and the detecting element is mounted on either the holder body or the carriage. Alternatively, the detected body is mounted on either the holder body or the carriage and the detecting element is mounted on the movable holder. In each case, the detector detects the detected portion of the detected body, so that the position of the movable holder relative to the holder body can reliably be detected. Further, when the detecting element is fixed to the carriage, the wiring arrangement from the detector can be simplified as compared with the case where the detector is provided at the movable holder side. Consequently, the wiring structure can be simplified.

In another preferred form, the detecting element includes a rotary potentiometer having a detecting member brought into contact with one of the detected portions of the detected body. The rotary potentiometer itself is relatively inexpensive and a single detector can detect a plurality of detected portions. Consequently, the detector can be simplified in the arrangement and rendered inexpensive.

In further another preferred form, the detected portions of the detected body have heights or widths differing from each other along a direction in which the movable holder is moved respectively. Alternatively, each detected portion of the detected body includes a tapered face having a height or a width changing therealong. In each case, the arrangement of the detected body can be simplified.

In further another preferred form, the holder body includes a guide mechanism guiding the movable holder to one of the positions by sliding movement and a positioning mechanism positioning the movable holder at the one of the positions. Consequently, the operator can easily displace the movable holder. Further, the movable holder can reliably be fixed to each position when the holder body includes a fixing mechanism fixing the movable holder positioned by the positioning mechanism to the holder body. In this case, the positions at which the movable holder is positioned by the positioning mechanism correspond to the detected portions of the detected body respectively.

As more concrete construction of the frame holder, each embroidery frame has both sides opposite to each other, and the frame holder is formed generally into a C-shape and includes a body fixed to the carriage and extending in one direction, the body of the frame holder having both ends, and two arms extending substantially perpendicularly from the ends of the body to support both sides of the embroidery frame respectively. In this case, the holder body of the frame holder includes the body and either one of the arms, and the movable holder includes the other arm mounted thereon so as to be displaceable relative to the body of the frame holder. Alternatively, each embroidery frame has both sides opposite to each other, and the frame holder is formed generally into a C-shape and includes a body fixed to the carriage and extending in one direction, the body of the frame holder having both ends, and two arms extending substantially perpendicularly from the ends of the body to support both sides of the embroidery frame respectively. In each case, the embroidery frame can be supported at two portions thereof, whereupon the embroidery frame can be moved with high rigidity.

BRIEF DESCRIPTION OF THE DRAWINGS

Other objects, features and advantages of the present invention will become clear upon reviewing the following description of the embodiment with reference to the accompanying drawings, in which.

DETAILED DESCRIPTION OF THE INVENTION

An embodiment of the present invention will be described with reference to FIGS. 1 to 9. In the embodiment, the invention will be applied to a multi-needle embroidery sewing machine which can perform an embroidery sewing using six embroidery threads and to which one of five embroidery frames having different sizes or sewing regions is attached. In the following description, the back-and-forth direction will be referred to as "the Y direction," whereas the right-and-left direction as viewed from the operator will be referred to as "the X direction."

Figure 1:
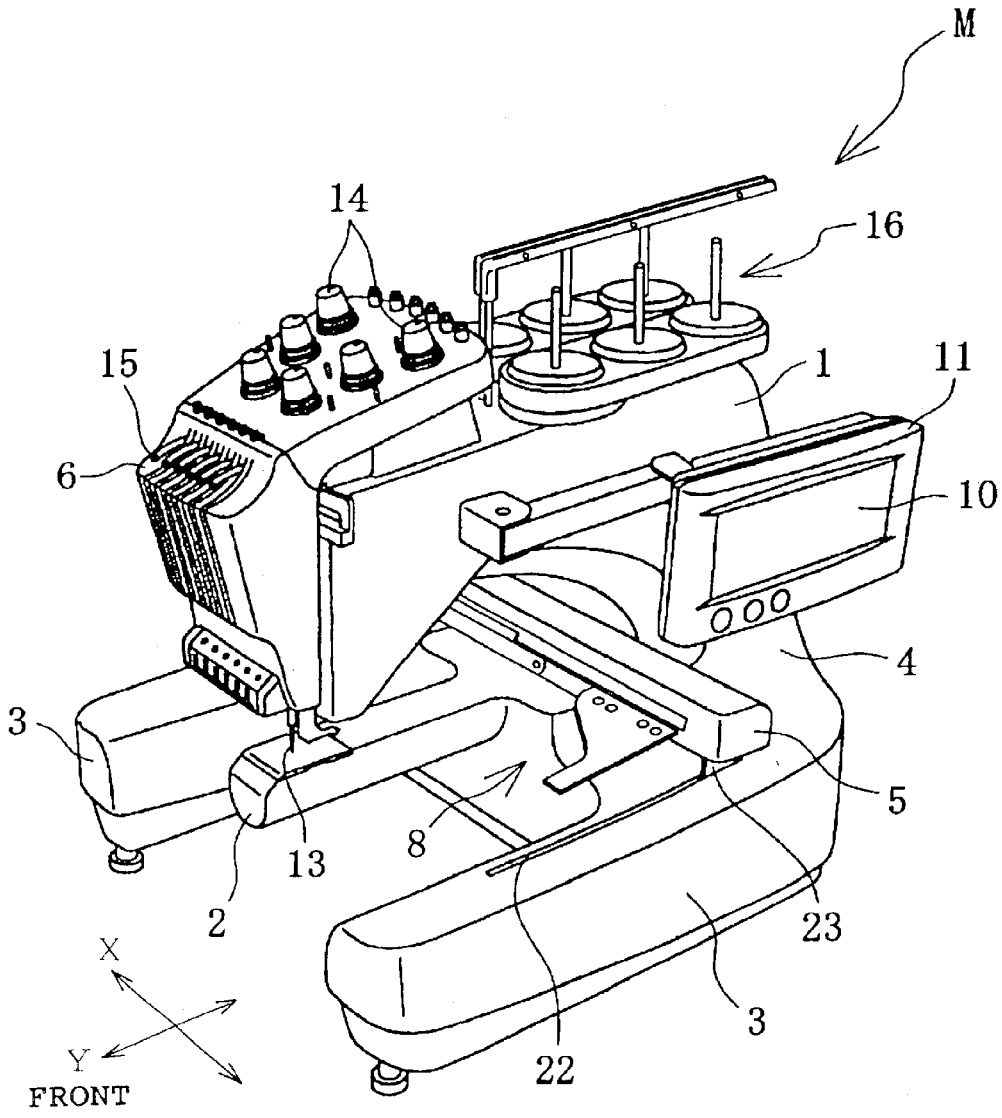
FIG. 1 is a perspective view of the overall embroidery sewing machine in accordance with an embodiment of the present invention.

Referring to FIG. 1, an overall construction of the multi-needle embroidery sewing machine M is shown. A support base 3 is placed on a mounting base (not shown) to support the embroidery sewing machine M. The support base 3 is formed generally into a U-shape and has an open front and includes a pillar 4 extending upward from a rear curved portion of the support base 3. A sewing arm 1 extends frontward from an upper end of the pillar 4. The arm 1 has a distal end on which a needle bar case 6 is mounted so as to be moved in the right-and-left direction (X direction). A cylindrical bed 2 is formed integrally with the support base 3 so as to extend frontward from the rear of the support base 3. A thread loop taker and the like (not shown) is provided in an interior of a distal end of the cylinder bed 2.

The needle bar case 6 includes, for example, six needle bars (none of them shown) and six thread take-up levers 15 both vertically movable. Sewing needles 13 are mounted to lower ends of the needle bars respectively. Only one of the sewing needles 13 is shown. A thread holder 16 is mounted on an upper part of the arm 1. Six thread spools (not shown) are set on the thread holder 16. Embroidery threads (needle threads) of six different colors are supplied via thread tension regulators 14 and thread take-up levers 15 to sewing needles 13 respectively. The thread holder 16 is switchable between a retracted position as shown in FIG. 1 and a position where the thread holder 16 is rearwardly spread generally into a V-shape.

The needle bar case 6 is moved in the X direction by a needle bar selecting mechanism (not shown) so that one of the needle bars to be driven is selected. Only the selected needle bar and corresponding thread take-up lever 15 are driven by a driving force transferred from a sewing machine motor 107 (see FIG. 9) provided in the pillar 4 via a needle bar vertically driving mechanism (not shown) provided in the arm 1, so that the selected needle bar and corresponding thread take-up lever 15 are vertically driven. At this time, the needle bar vertically driving mechanism forms embroidery stitches in cooperation with a thread loop taker (not shown) also driven by the motor 107 using the selected embroidery thread of the selected color.

Three carriages 5 are mounted on the support bases 3 respectively. Each carriage 5 is located over the cylinder bed 2 and freely moved independently in the X and Y directions perpendicular to each other. A frame holder 8 is mounted on each carriage 5. An embroidery frame 7 (see FIGS. 2 and 4) holding workpiece cloth is detachably attached to the frame holder 8. An embroidery frame detector 9 (see FIGS. 2 to 5) is provided on the frame holder 8 for detecting a type of the embroidery frame 7. The carriage 5, frame holder 8, embroidery frame 7 and embroidery frame detector 9 will be described in detail later.

An operation panel 11 on which the operator enters various input is provided on the right side of the arm 1. The operation panel 11 includes a display 10 on which an image of embroidery pattern and the like is displayed. The operation panel 11 is displaceable (foldable) between a retracted position as shown in FIG. 1 and a use position where the display 10 is directed frontward.

The embroidery sewing machine M further comprises a control unit 100 (see FIG. 9) for controlling the overall embroidery sewing machine. Based on embroidery data and the like, the control unit 100 controls the sewing machine motor 107, the needle bar selecting mechanism, the moving mechanism and the like, whereby an embroidery sewing operation is automatically carried out for the workpiece cloth held on the embroidery frame 7.

Figure 2:
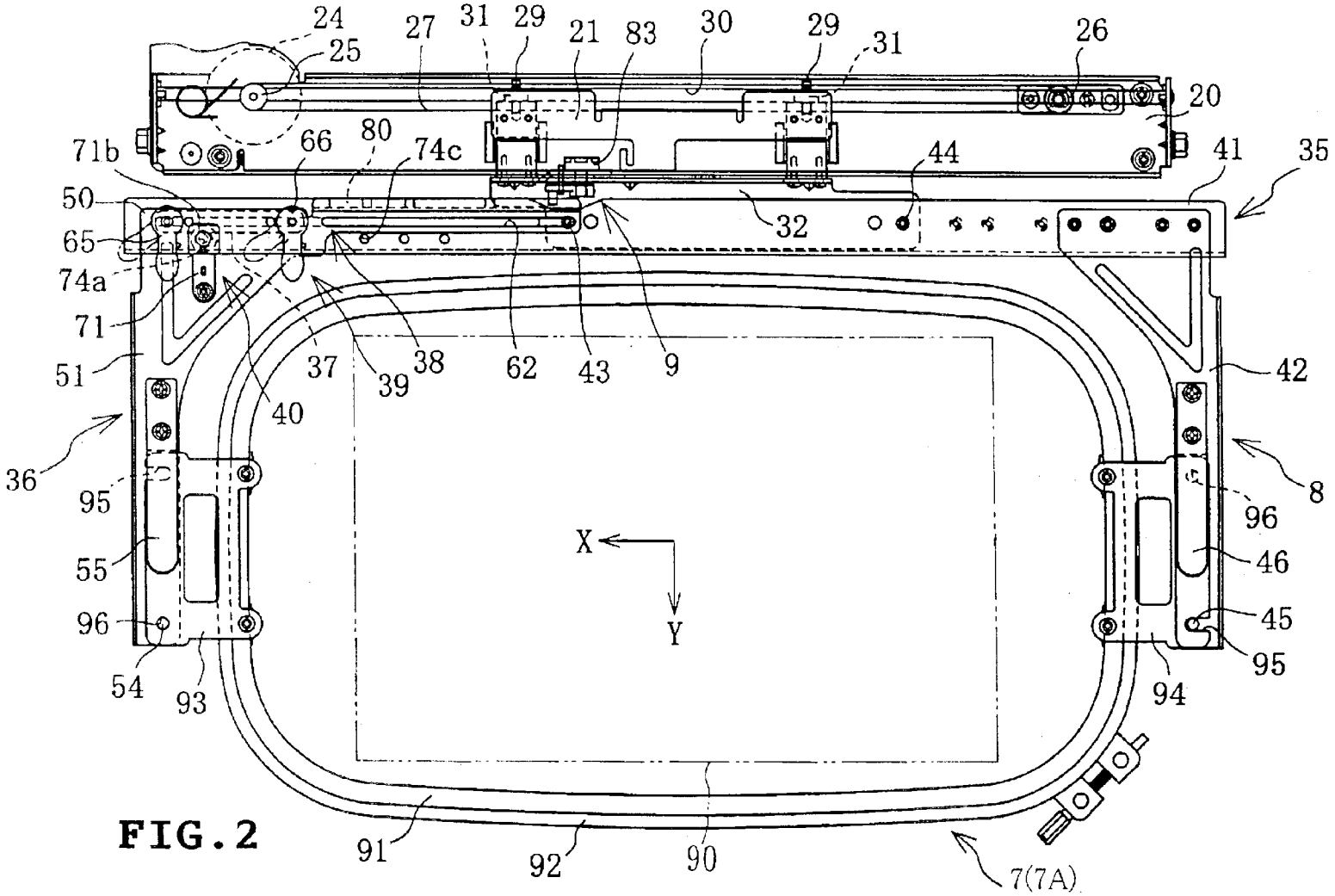
FIG. 2 is a plan view of a frame holder to which a largest embroidery frame is attached.
Figure 4:
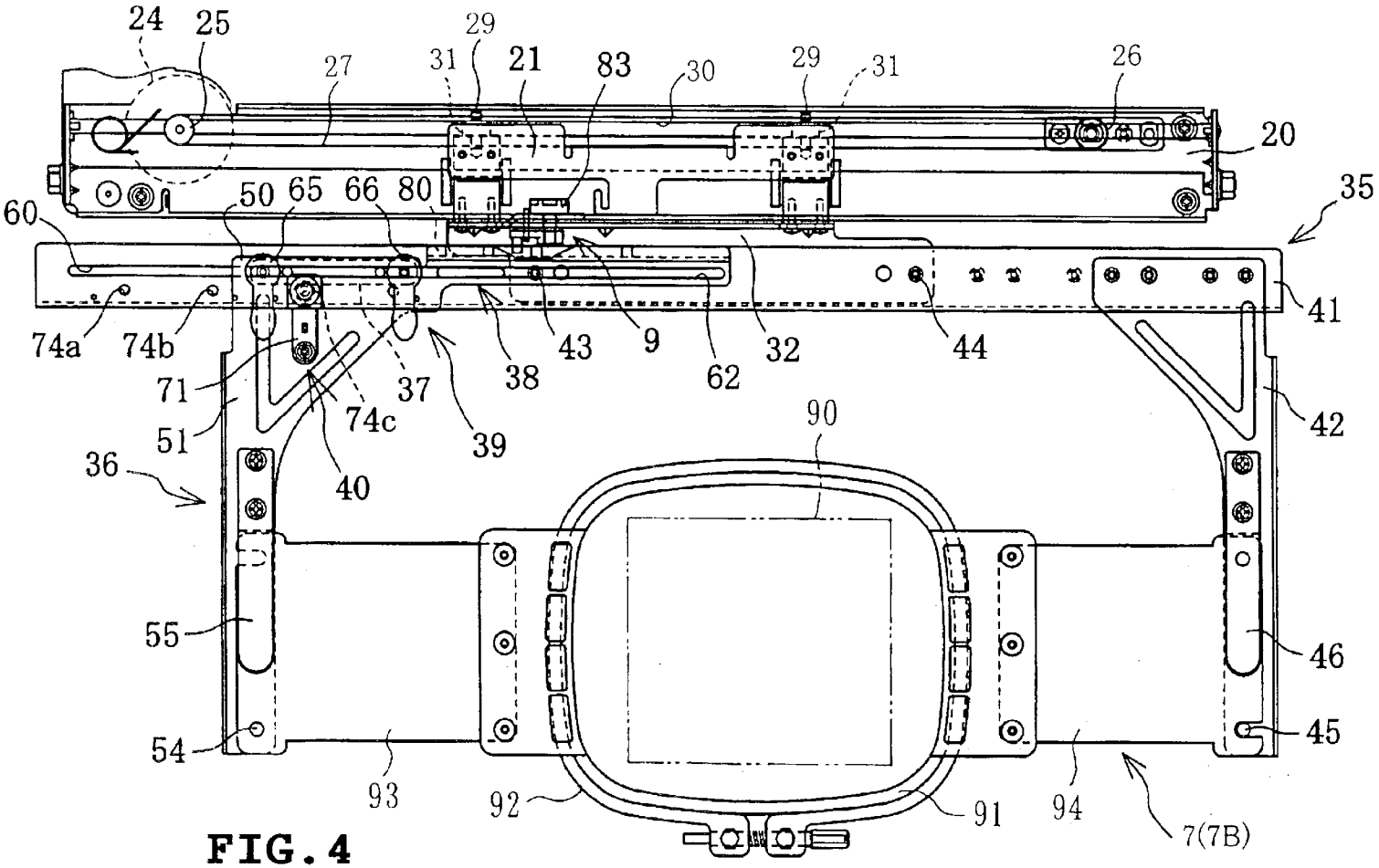
FIG. 4 is a plan view of the frame holder to which a third larger embroidery frame is attached.

The carriage 5 will now be described. The carriage 5 includes a Y-direction carriage 20 and an X-direction carriage 21 mounted on the Y-direction carriage 20 as shown in FIGS. 2 and 4. The Y-direction carriage 20 extends in the X direction over the left and right support bases 3. The support bases 3 have guide grooves 22 formed in the upper sides so as to extend in the Y direction respectively. Only one of the guide grooves 22 is shown in FIG. 1. Two legs 23 only one of which is shown are inserted into the guide grooves 22 respectively. Left and right ends of the Y-direction carriage 20 are coupled to the paired legs 23 respectively. Driving force of a Y-direction drive motor 110 is transmitted via a Y-direction driving force transferring mechanism to the legs 23. Consequently, the Y-direction carriage 20 is moved freely in the Y direction.

The X-direction carriage 21 is formed into the shape of an oblong plate and includes a coupling member 32 provided in the front thereof as shown in FIGS. 2 and 4. The X-direction carriage 21 further includes a pair of engagement members 31 provided on the rear right and left ends thereof respectively. The engagement members 31 are in engagement with guide grooves 30 formed in the Y-direction carriage 20 so as to extend in the X direction respectively. The X-direction carriage 21 is connected at two positions by two connecting pins 29 respectively to an endless timing belt 27 as shown in FIGS. 2 and 4. The timing belt 27 extends between a pulley 25 and a driven pulley 26. The pulley 25 is mounted on an output shaft of an X-direction driving motor 24 mounted on the left end of the Y-direction carriage 20. The driven pulley 26 is mounted on the right end of the Y-direction carriage 20. As the result of the aforesaid construction, the driving force of the X-direction driving motor 24 is transferred via the timing belt 27 to the X-direction carriage 21, which is guided by a guide groove 30 thereby to be moved in the X direction within the Y-direction carriage 20.

Thus, the Y-direction carriage 20 is moved freely in the Y direction relative to the support base 3 by the Y-direction driving motor 110 and the like, whereas the X-direction carriage 21 is moved freely in the X direction within the Y-direction carriage 20 by the X-direction driving motor 24 and the like. Consequently, the frame holder 8 coupled to the X-direction carriage 21 is moved freely in the X and Y directions.

The five types of embroidery frames 7 will be described. Each embroidery frame 7 includes an embroidery frame body (inner frame) 91 formed into the shape of a rectangular frame having rounded corners and an outer frame 92 detachably fitted with an outer periphery of the embroidery frame body 91. Each embroidery frame 7 further includes a pair of arms 93 and 94 fixed to both opposite ends of the embroidery frame body 91 respectively. A piece of workpiece cloth is held between the embroidery frame body 91 and the outer frame 92 thereby to be held in a stretched state inside the embroidery frame body 91. In this case, a generally rectangular sewing region 90 having a predetermined size is set inside the embroidery frame body 91. The arms 93 and 94 are disposed so as to be symmetrical with each other about the center of the embroidery frame 7. Each of the arms 93 and 94 has an engagement groove 95 and an engagement hole 96 for attachment of the embroidery frame 7 to the frame holder 8.

The five types of embroidery frames 7 differ from one another in the size (shape) of an embroidery frame body 91 and accordingly have respective sewing regions 90 differing from one another in the size (shape) thereof. Further, the embroidery frames 7 inclusive of the respective arms 93 and 94 have different lateral dimensions or widths. The width of the embroidery frame becomes larger as the size of the embroidery frame body is increased. One of the embroidery frames 7 is selectively used according to the size of an embroidery frame to be formed (the size of the sewing region 90), the size of workpiece cloth or the like. FIG. 2 shows the largest embroidery frame 7, whereas FIG. 4 shows the third largest embroidery frame 7. When each of the embroidery frames 7 need to be distinguished from each other in the following description, the largest one will be referred to as "embroidery frame 7A", whereas the third largest one will be referred to as "embroidery frame 7B."

The frame holder 8 will be described. The frame holder 8 includes a holder body 35 fixed to the coupling member 32 of the X-direction carriage 21 and a movable holder 36 mounted on the holder body 35 so as to be displaceable or movable, as shown in FIGS. 2 and 4. The frame holder 8 is thus formed into a C-shape and has a front opening. The movable holder 36 is slid by the guiding mechanism 38 thereby to be guided relative to the holder body 35. Further, the movable holder 36 is positioned by a positioning mechanism 40 at one of five positions corresponding to the widths of the five embroidery frames 7 respectively. The movable holder 36 thus positioned is fixed to the holder body 35 by a fixing mechanism 39.

The holder body 35 includes a main body 41 formed into the shape of an oblong plate and a right arm 42 extending forward substantially perpendicularly from a right end of the main body 41 as shown in FIGS. 2 and 4. The main body 41 is elongated in the X direction and has a downwardly bent front edge. The holder body 35 is thus generally formed into an L-shape. The main body 41 includes a central portion fixed by two small screws 43 and 44 to an upper face of the coupling member 32 of the X-direction carriage 21. The right arm 42 has a distal end provided with an engaging pin 45 engaging an engagement groove 95 of the embroidery frame 7. A leaf spring 46 is mounted on the right arm 42 so as to be located in the rear of the engaging pin 45. The arms 93 and 94 of the embroidery frame 7 are adapted to be held between the leaf spring 46 and the right arm 42 when the embroidery frame 7 has been inserted from the front.

The movable holder 36 includes an oblong coupling portion 50 and a left arm 51 extending forward from a left end of the coupling portion 50 (substantially perpendicularly from the main body 41) as shown in FIGS. 2 and 4. The coupling portion 50 and the left arm 51 are formed integrally with the movable holder 36 generally into an L-shape. The coupling portion 50 is adapted to be coupled to an upper face of the main body 41. The left arm 51 is disposed opposite the right arm and includes an engaging pin 54 engaging the engagement hole 96 of the embroidery frame 7 and a leaf spring 55. The arms 93 and 94 of the embroidery frame 7 are adapted to be held between the leaf spring 55 and the left arm 51 when the embroidery frame 7 has been inserted from the front. Accordingly, the left and right arms 93 and 94 of the embroidery frame 7 are supported on the left and right arms 51 and 42 respectively.

Figure 5:
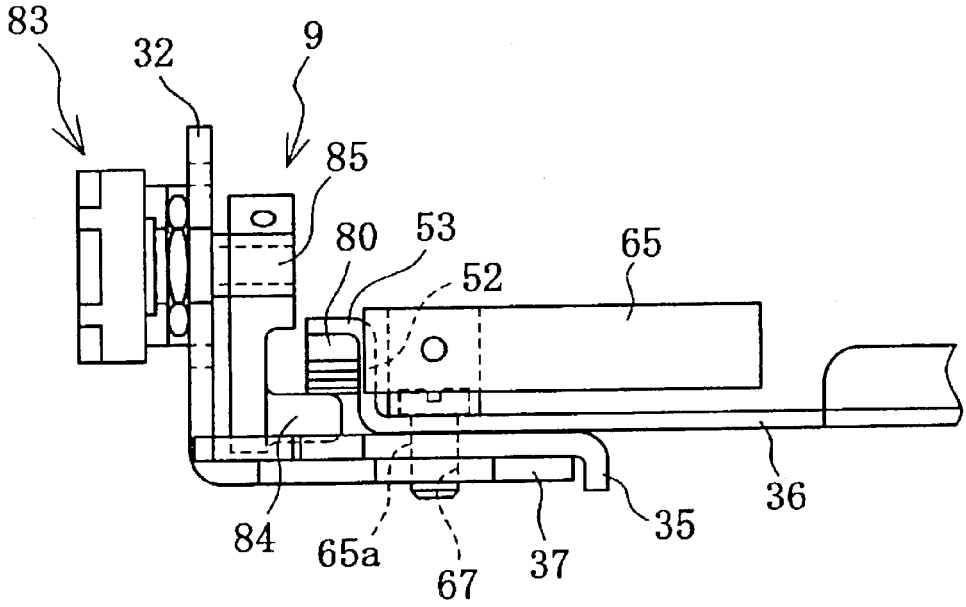
FIG. 5 is a left side view of the latter half of the frame holder.
Figure 6:
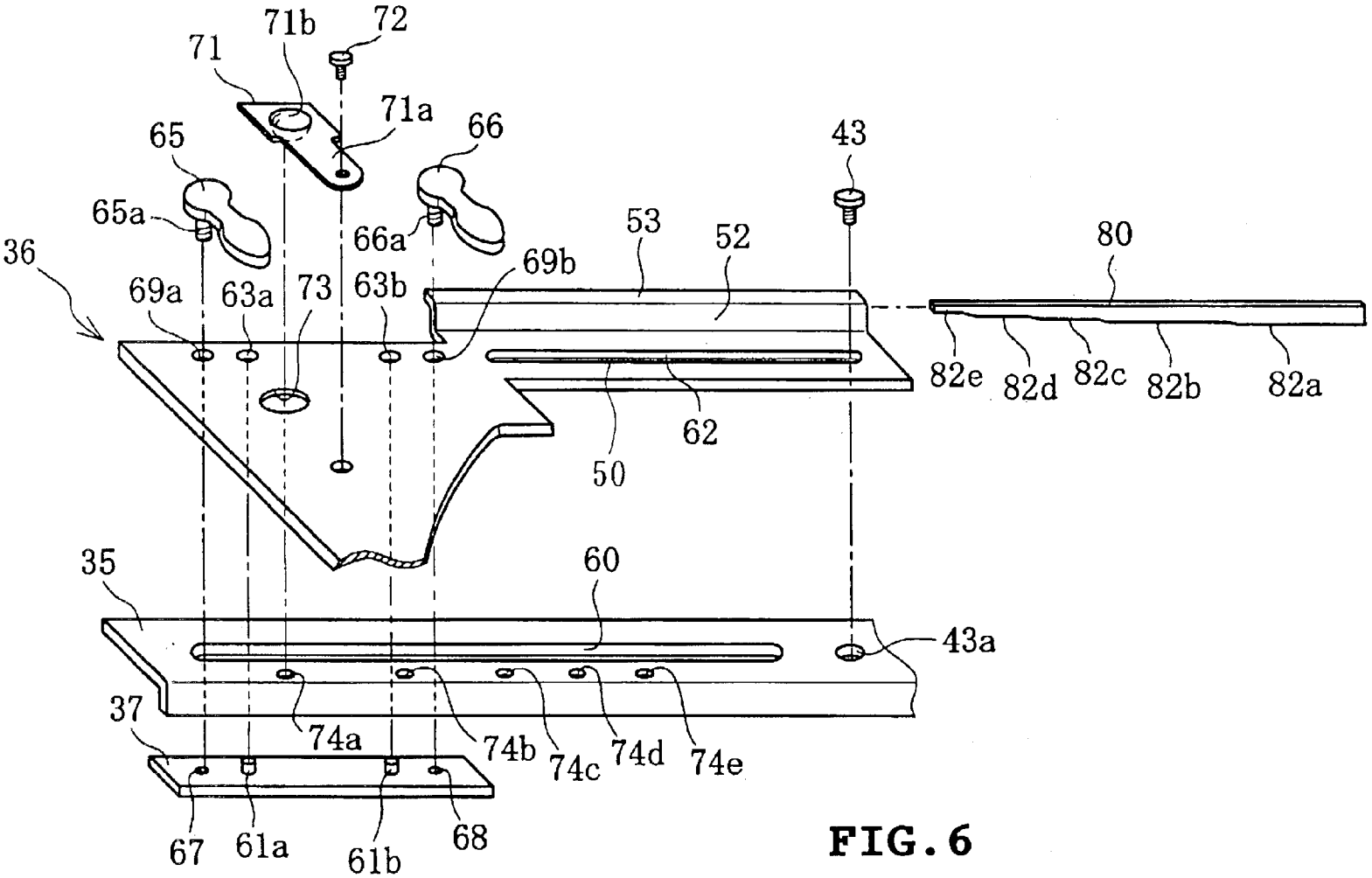
FIG. 6 is a schematically exploded perspective view of the left latter half of the frame holder.

The coupling portion 50 has a rising wall 52 extending from the central portion to the right end thereof as shown in FIGS. 5 and 6. The rising wall 52 has an upper end provided with a rearwardly bent attachment portion 53. A detected body 80 is attached to the underside of the attachment portion 53 as will be described later.

An auxiliary plate 37 is attached to the underside of the holder body 35 so as to hold the holder body 35 between itself and the movable holder 36 as shown in FIGS. 5 and 6. The auxiliary plate 37 is formed into a rectangular shape and has left and right ends formed with a pair of screw holes 67 and 68 with which thread portions 65*a* and 66*a* of the fixing mechanism 39 are threadedly engaged respectively as shown in FIG. 6. Two guide pins 61*a* and 61*b* are formed on the upper side of the auxiliary plate 37 so as to be located inside the screw holes 67 and 68 respectively.

The guiding mechanism 38 is constructed as follows. The main body 41 of the holder body 35 has a first guide groove 60 extending in the X direction from the left end to the central portion thereof as shown in FIG. 6. The paired guide pins 61*a* and 61*b* are inserted through the first guide groove 60. The guide pins 61*a* and 61*b* have distal ends which are inserted into a pair of pin holes 63*a* and 63*b* formed in the left end of the movable holder 36 respectively. The coupling portion 50 of the movable holder 36 has a second guide groove 62 extending in the X direction from the central portion to the right end thereof. The holder body 35 has a pin hole 43*a* formed therein to the right of the first guide groove 60. A small screw 43 is inserted through the second guide groove 62 and the pin hole 43*a* to be engaged with a screw hole (not shown) of the coupling member 32. Accordingly, the guide pins 61*a* and 61*b* fitted in the respective pin holes 63*a* and 63*b* are guided along the first guide groove 60, and the small screw 43 is guided along the second guide groove 62. As a result, the movable holder 36 and accordingly the auxiliary plate 37 are guided in the right-and-left direction relative to the holder body 35. The guiding mechanism 38 is thus constructed.

The fixing mechanism 39 includes a pair of fixing knobs 65 and 66 having lower ends formed with threaded portions 65*a* and 66*a* respectively as shown in FIG. 6. The movable holder 36 has two pin holes 69*a* and 69*b*. The threaded portions 65*a* and 66*a* of the fixing knobs 65 and 66 are inserted through pin holes 69*a* and 69*b* and the first guide groove 60 of the holder body 35 to be engaged with screw holes 67 and 68 of the auxiliary plate 37. When the fixing knobs 65 and 66 are located so as to be directed frontward as shown by solid line in FIGS. 2 and 3, the holder body 35 is held tightly between the moving holder 36 and the auxiliary plate 37, whereby the movable holder 36 is fixed to the holder body 35. On the other hand, threaded engagement of the screws 65*a* and 66*a* with the respective screw holes 67 and 68 is loosened when the fixing knobs 65 and 66 are turned clockwise as shown by two-dot chain line in FIGS. 2 and 3 to be changed to positions where the fixing knobs 65 and 66 are directed obliquely leftward. Consequently, the movable holder 36 can be slid in the X direction relative to the holder body 35.

The positioning mechanism 40 includes a positioning member 71 having a front end mounted to the movable holder 36 and five positioning holes 74*a* to 74*e* formed in the holder body 35 so as to be located in front of the first guide groove 60, as shown in FIG. 6. The positioning member 71 has a semispherical engagement convexity 71*b* formed on a rear end of a leaf spring 71*a* so as to project downward. The engagement convexity 71*b* is inserted through an insertion hole 73 formed through the movable holder 36, projecting from the underside of the movable holder 36 to be engaged with any one of the positioning holes 74*a* to 74*e*. The positioning holes 74*a* to 74*e* are formed so as to correspond to the widths of the five embroidery frames 7. With slide of the movable holder 36 in the X direction, the engagement convexity 71*b* of the positioning member 71 is disengaged from one of the positioning holes 74*a* to 74*e* and slightly brought up against the spring force of the leaf spring 71*a*. Consequently, the engagement convexity 71*b* is moved while sliding on the upper side of the holder body 35 (between the positioning holes 74*a* to 74*e*). When the engagement convexity 71*b* corresponds with the subsequent one of the positioning holes 74*a* to 74*e*, the spring force engages the engagement convexity 71*b* with that positioning hole. This provides clicking. As a result, the movable holder 36 is positioned and fixed at any one of five positions having different distances between the right arm 42 and them by the positioning mechanism 40. One of the five embroidery frames 7 is attachable when the movable holder 36 is positioned at any one of the positions.

Figure 3:
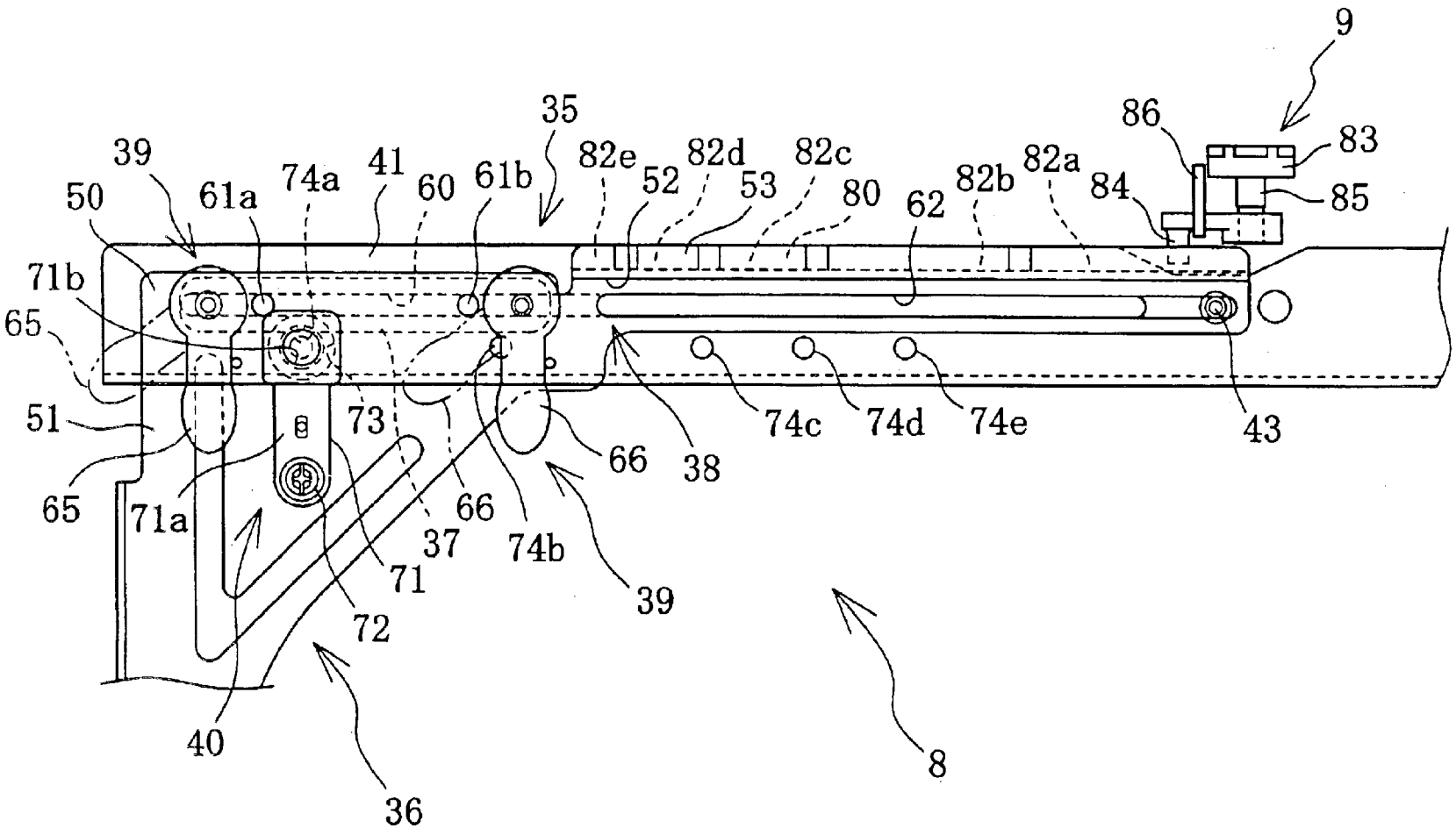
FIG. 3 is an enlarged plan view of the left latter half of the frame holder used in the embroidery sewing machine.

For example, when the engagement convexity 71*b* is in engagement with the leftmost positioning hole 74*a*, the movable holder 36 is mounted to assume the leftmost position, whereupon the largest embroidery frame 7A can be attached to the frame holder 8, as shown in FIGS. 2 and 3. In this state, the movable holder 36 is released from the fixing by the fixing mechanism 39 and then moved by the positioning mechanism 40 to a position corresponding to the third positioning hole 74*c* while being guided rightward by the guiding mechanism 38. Subsequently, the movable holder 36 is fixed by the fixing mechanism 39 again. Thus, the third largest embroidery frame 7B can be attached to the frame holder 8 as shown in FIG. 4.

In attaching the embroidery frame 7 to the frame holder 8, the operator puts both arms 93 and 94 of the embroidery frame 7 between the leaf springs 46 and 55 and the right and left arms 42 and 51, inserting the arms 93 and 94 while the front portion of the embroidery frame 7 is inclined slightly upward. The embroidery frame 7 is then returned to the horizontal state and the engaging pin 54 of the left arm 51 is engaged with the engagement hole 96 of the arm 93, whereas the engaging pin 45 of the right arm 42 is engaged with the engagement groove 95 of the arm 94. As a result, the embroidery frame 7 is supported at two points by the frame holder B. Since the arms 93 and 94 have the same structure, the embroidery frame 7 may be attached to the frame holder 8 in the reversed state.

The embroidery frame detector 9 for detecting the five types of embroidery frames 7 will now be described. The embroidery frame detector 9 includes a detected body 80 made from a synthetic material and attached to the underside of the attachment portion 53 of the movable holder 36 and a detecting element 83 mounted on the coupling member 32 of the X-direction carriage 21. The detected body 80 is formed into the shape of a square bar elongated in the X direction and has an underside becoming higher stepwise from a right end to a left end so as to correspond to five positions, whereby five detected portions 82*a* to 82*e* are formed, as shown in FIGS. 6 and 8A to 8E. Spaces between centers of detected portions 82*a* to 82*e* adjacent to each other are approximately the same as spaces between the positioning holes 74*a* to 74*e* of the positioning mechanism 40.

Figure 7:
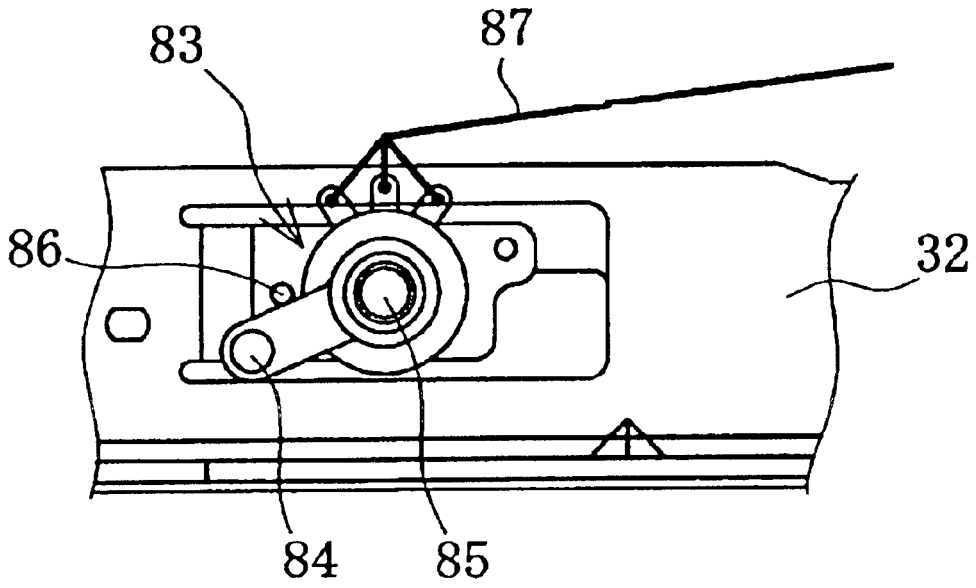
FIG. 7 is a front view of a detector.

In the embodiment, the detecting element 83 comprises a rotary potentiometer having a detecting member 84 projecting frontward as shown in FIG. 7. The detecting member 84 is adapted to be brought into contact with any one of the detected portions 82*a* to 82*e*. The detecting member 84 is biased clockwise about a shaft 85 by a coil spring incorporated in the detecting element 83. A variable resistor incorporated in the detecting element 83 varies its resistance value as the detecting member 84 is rotated about the shaft 85. When supplied with a predetermined voltage, the detecting element 83 delivers an output signal which is indicative of the changes in the resistance value depending upon a rotational position of the detecting member 84 or changes in the current value with the changes in the resistance value. A stopper 86 is mounted on the coupling member 32 so as to protrude frontward. Even when brought out of contact with the detected portions 82*a* to 82*e*, the detecting member 84 is stopped by the stopper after having been turned by a predetermined angle. Wiring 87 from the detecting element 83 is drawn upward.

FIGS. 8A to 8E illustrate a manner of detecting the type of the embroidery frame 7 by the embroidery frame detector 9. When the movable holder 36 is moved in the right-and-left direction, the detected body 80 attached to the movable holder 36 is also moved with the latter. Accordingly, the detecting member 84 of the detecting element 83 is turned about the shaft 85 when brought into contact with any one of the detected portions 82*a* to 82*e* formed on the detected body 80. When the movable holder 36 is positioned at a desired position by the positioning mechanism 40, the detecting member 84 of the detecting element 83 is brought into contact with any one of the detected portions 82*a* to 82*e* corresponding to the determined position. In this case, when the detecting member 84 is in contact with any one of the detected portions 82*a* to 82*e*, the detecting element 83 delivers an output signal with any one of current values I1 to I5. Accordingly, the detecting element 83 detects any one of detected portions 82*a* to 82*e* corresponding to the position of the movable holder 36, whereupon the type of the embroidery frame 7 to be attached to the frame holder 8 can be detected indirectly.

Figures 8A, 8B, 8C, 8D, 8E:
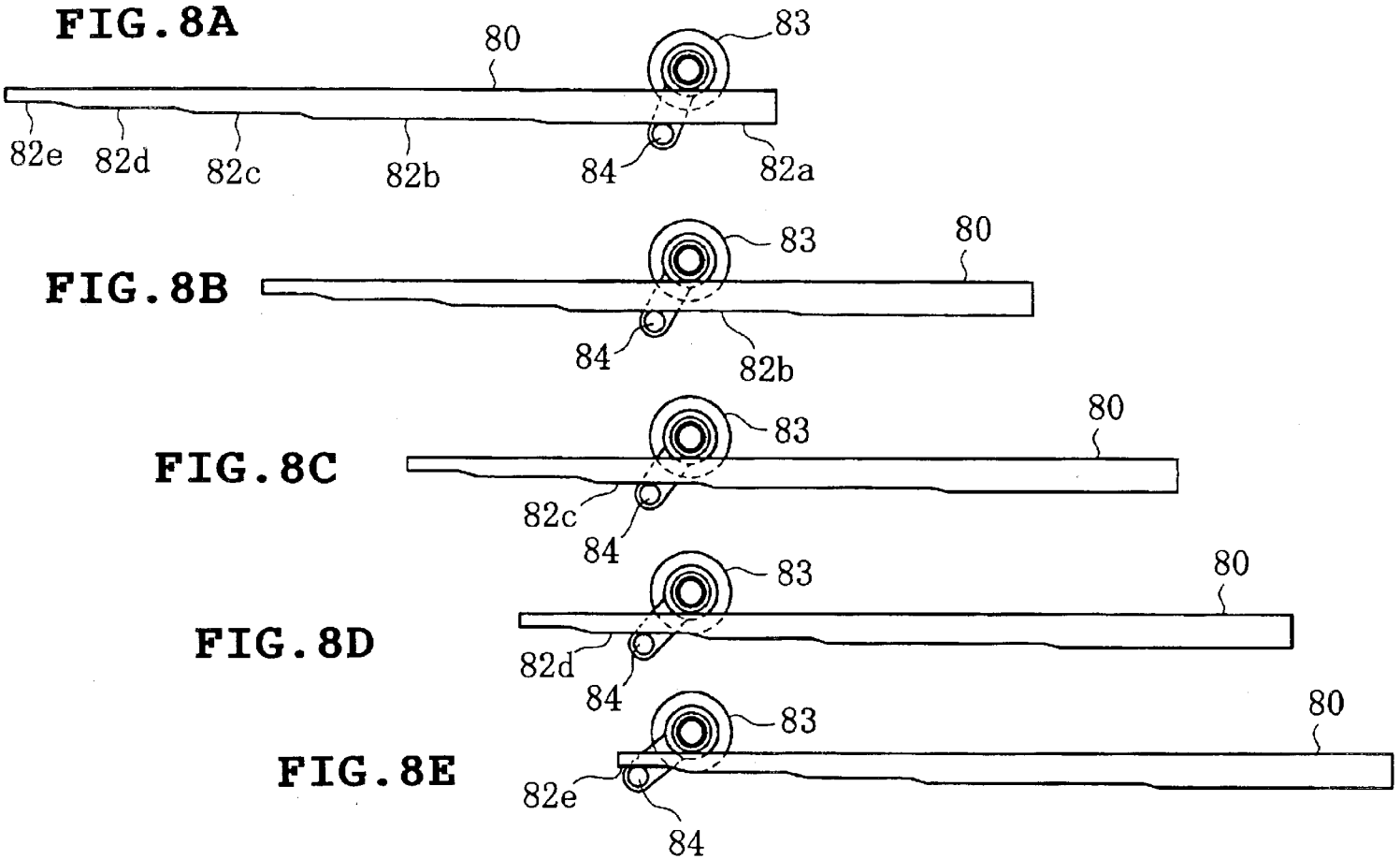
FIGS. 8A to 8E are front views of the detector and a detected body, showing operations of these components.

For example, in order that the largest embroidery frame 7A may be attached, the engagement convexity 71*b* is engaged with the positioning hole 74*a* so that the movable holder 36 is fixed, as shown in FIG. 2. The detecting member 84 is then brought into contact with the detected portion 82*a*, so that the embroidery frame 7 (7A) to be attached is detected, as shown in FIG. 8A. Further, in order that the third largest embroidery frame 7B may be attached, the engagement convexity 71*b* is engaged with the positioning hole 74*c* so that the movable holder 36 is fixed, as shown in FIG. 4. The detecting member 84 is then brought into contact with the detected portion 82*c*, so that the embroidery frame 7B to be attached is detected, as shown in FIG. 8C.

The type of each of the other embroidery frames is detected in the same manner as described above. More specifically, when the engagement convexity 71*b* is in engagement with the positioning hole 74*b*, the detecting member 84 is brought into contact with the detected portion 82*b* as shown in FIG. 8B. When the engagement convexity 71*b* is in engagement with the positioning hole 74*d*, the detecting member 84 is brought into contact with the detected portion 82*d* as shown in FIG. 8D. When the engagement convexity 71*b* is in engagement with the positioning hole 74*e*, the detecting member 84 is brought into contact with the detected portion 82*e* as shown in FIG. 8E. Consequently, the embroidery frame 7 to be attached can be detected in each of the above-described cases.

Figure 9:
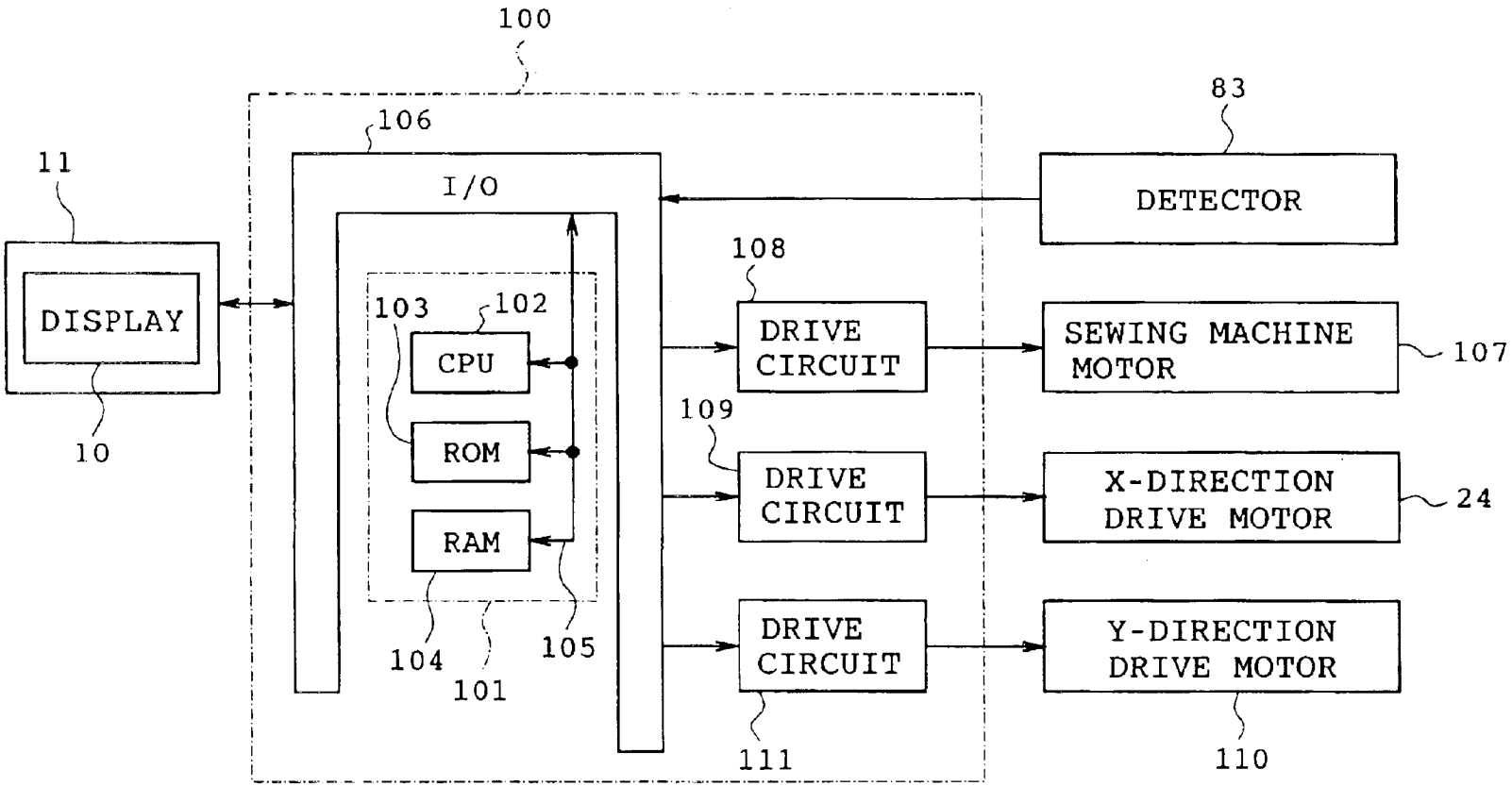
FIG. 9 is a block diagram showing a control unit.

A control unit 100 will now be described. The control unit 100 controls the overall operation of the embroidery sewing machine M. Referring to FIG. 9, the control unit 100 comprises a computer 101 and an input-output interface 106 via which signals are supplied into and delivered from the computer 101. The computer 101 includes CPU 102, ROM 103, RAM 104 and a bus 105 connecting the former components to one another. To the input-output interface 106 are connected a drive circuit 108 for the sewing machine motor 107, a drive circuit 109 for the X-direction drive motor 24, a drive circuit 111 for the Y-direction drive motor 110 and the like. The detecting element 83 and the operation panel 11 are also connected to the input-output interface 106. ROM 103 stores an embroidery frame type determining program for determining the type of the embroidery frame 7, embroidery data used for execution of an embroidery sewing operation and the like. RAM 104 stores various data such as data of current values read from the detecting element 83 and the like. The aforesaid embroidery data includes data indicative of a needle location for every stitch relative to workpiece cloth (or movement amounts of the embroidery frame 7 in the X and Y directions) and the like. The control unit 100 controls the sewing machine motor 107 and the moving mechanism (the X direction drive motor 24 and the Y direction drive motor 110) based on the embroidery data, so that the carriage 5 and accordingly the embroidery frame 7 supported on the frame holder 8 are moved in the X and Y directions, whereby an embroidery forming operation is carried out on the workpiece cloth.

An embroidery frame type determining program will be described. The control unit 100 determines a type of the embroidery frame 7 to be attached based on the signal delivered from the detecting element 83 and the embroidery frame type determining program. In order that a desired embroidery frame 7 may be attached, the movable holder 36 is positioned at a predetermined position and fixed by the positioning mechanism 40. The detecting member 84 of the detecting element 83 is then brought into contact with any one of the detected portions 82*a* to 82*e* of the detected body 80 corresponding to the position of the movable holder 36 to be held in the state. The resistance value of the detecting element 83 varies according to a rotational angle of the held detecting member 84. An output signal (one of current values I1 to I5) according to the resistance value is supplied to the control unit 100. The control unit 100 determines the embroidery frame 7 to be attached based on the supplied output signal. Accordingly, the control unit 100 serves as a determining unit.

For example, when the engagement convexity 71*b* is in engagement with the positioning hole 74*a*, the control unit 100 reads the current value I1 and the embroidery frame 7A is determined as shown in FIG. 2. Further, when the engagement convexity 71*b* is in engagement with the positioning hole 74*c*, the control unit 100 reads the current value I3 and the embroidery frame 7B is determined as shown in FIG. 4. When the embroidery frame 7 to be attached does not correspond to the size of embroidery data selected by the operator, the control unit 100 having determined the type of the embroidery frame 7 displays an alarm message on the display 10 of the operation panel 11 or produces alarming sound to inform the operator that the embroidery frame 7 is unsuitable.

The following effects can be achieved from the above-described embroidery sewing machine. The embroidery frame 7 is supported on the frame holder 8 mounted on the carriage 5 in the foregoing embodiment. On this occasion, the position of the movable holder 36 relative to the holder body 35 of the frame holder 8 is changed according to the type of the embroidery frame 7, and the embroidery frame detector 9 is provided for detecting the position of the movable holder 36. Accordingly, when the movable holder 36 is just positioned so as to correspond to a desired embroidery frame 7, the position of the movable holder 36 is detected by the embroidery frame detector 9, whereby the type of the embroidery frame 7 to be attached is determined. Consequently, since the type of the embroidery frame 7 is determined before attached to the frame holder 8, the detection of the type of the embroidery frame 7 can be carried out in a short period of time.

Further, when the operator is attaching a wrong embroidery frame 7, an alarming operation can be carried out before the wrong embroidery frame 7 is attached. Consequently, a wrong embroidery frame 7 not corresponding to the embroidery data can be prevented from being attached. This can save a period of time required to replace the attached embroidery frame 7 by a correct one and a period of time required to detach the workpiece cloth from one embroidery frame and re-attach it to another one.

The embroidery frame detector 9 includes the detecting element 83 comprising the relatively inexpensive rotary potentiometer and the single detected body 80 having the five detected portions 82*a* to 82*e*. As a result, the construction and arrangement of the detecting element 83 can be simplified and the detecting element 83 can be produced at low costs. The detected body 80 can also be simplified. Consequently, the overall embroidery frame detector 9 can be simplified. Further, since the detecting element 83 is disposed at the carriage 5 side, the wiring arrangement from the detecting element 83 can be simplified as compared with the case where the detecting element is disposed at the movable holder 36 side. Additionally, the frame holder 8 is provided with the guiding mechanism 38 for changing the position of the movable holder 36, the fixing mechanism 39 and the positioning mechanism 40. Consequently, the operator can change the position of the movable holder 36 readily and reliably.

The invention should not be limited to the foregoing embodiment. The embodiment can be modified or expanded as follows. In the foregoing embodiment, the detected body 80 is attached to the attachment portion 53 of the movable holder 36 so that the detected portions 82*a* to 82*e* are located higher and higher from the right to the left. However, the detected body 80 may be attached to the attachment portion 53 so that the detected portions 82*a* to 82*e* are directed in the back-and-forth direction, instead. In this case, the detecting member 84 of the detecting element 83 may be attached so as to be brought into contact with the detected portions 82*a* to 82*e*. Accordingly, the difference in the width of the detected body 80 is detected by the detecting element 83, whereby the type of the embroidery frame 7 is determined.

Figure 10:
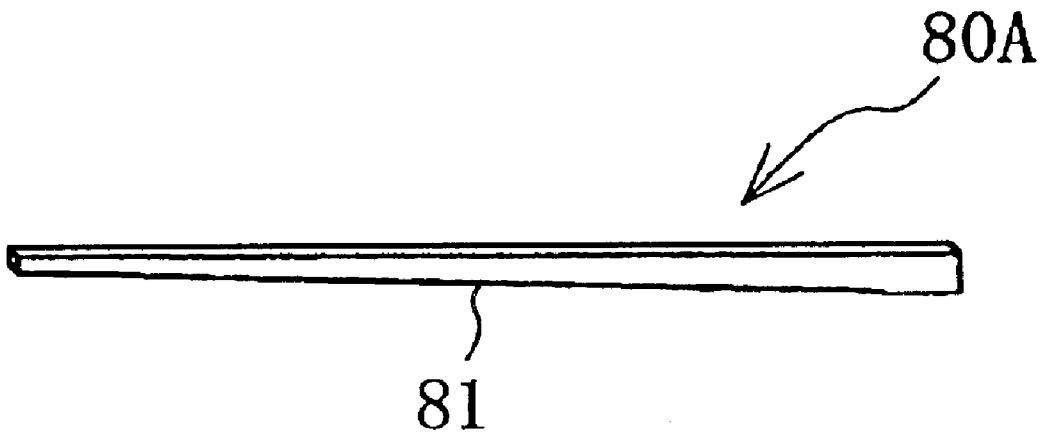
FIG. 10 is a perspective view of the detected body in a modified form.

In the foregoing embodiment, the detected body 80 is formed with five detected portions 82*a* to 82*e* located higher and higher from the right to the left so as to correspond to the embroidery frames 7 respectively. However, the detected body 80A may be made of a tapered member without the stepped portions of the detected portions 82*a* to 82*e* and a tapered face of the tapered member may serve as a plurality of detected portions, as shown in FIG. 10, instead. When the detected body 80A is constructed as described above, a range of value of current from the detecting element 83 is previously set so as to correspond to the size of the embroidery frame, so that the type of the embroidery frame 7 is detected according to the current value. In this arrangement, too, the detected portion 81 may be directed in any direction.

Only the flat embroidery frames 7 can be attached in the foregoing embodiment. However, a cap frame used to form embroidery on a peripheral portion of a cap may be attachable. In this case, too, it is desirable that the cap frame can also be detected by the detecting element such as the potentiometer.

The invention is applied to a multi-needle embroidery sewing machine M in the foregoing embodiment. However, the invention may be applied to any type embroidery sewing machine to which a plurality of embroidery frames are attachable, such as single needle embroidery sewing machines.

The operator manually changes the position of the movable holder 36 in the foregoing embodiment. However, the invention may be applied to an embroidery sewing machine in which the position of the movable holder is automatically changed on the basis of image data or the like selected on the operation panel.

The holder body 35 comprises the body 41 and the right arm 42 in the foregoing embodiment. However, the holder body may comprise only the body 41, and the left and right arms 51 and 42 serving as movable holders may be mounted on the holder body so as to be displaceable.

The detecting element 83 is attached to the carriage 5 (the X direction carriage 21) in the foregoing embodiment. However, the detecting element 83 may be attached to the holder body if the detected portion of the detected body is detectable.

The detected body 80 is attached to the movable holder 36 and the detecting element 83 is attached to the carriage 5 in the foregoing embodiment. However, the detected body may be attached to the carriage or the holder body, whereas the detecting element may be attached to the movable holder, instead.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. An embroidery sewing machine in which a workpiece cloth is moved so that an embroidery pattern is formed thereon, the embroidery sewing machine comprising:

a plurality of types of embroidery frames differing in a size and/or a shape from each other and holding the workpiece cloth, the embroidery frames being selectively used;

a carriage;

a moving mechanism moving the carriage independently in two directions perpendicular to each other;

a frame holder to which the embroidery frames are selectively attached, the frame holder including a holder body fixed to the carriage and a movable holder mounted to one of a plurality of positions corresponding to the respective types of the embroidery frames relative to the holder body so that the position of the movable holder is exchangeable;

a detector detecting a position of the movable holder relative to the holder body; and a determining unit determining the type of the embroidery frame based on a result of detection by the detector.

2. An embroidery sewing machine according to claim 1, wherein the detector includes a detected body provided with a plurality of detected portions corresponding to the embroidery frames respectively and a detecting element detecting the detected portion of the detected body.

3. An embroidery sewing machine according to claim 2, wherein the detected body is mounted on the movable holder and the detecting element is mounted on either the holder body or the carriage.

4. An embroidery sewing machine according to claim 2, wherein the detected body is mounted on either the holder body or the carriage and the detecting element is mounted on the movable holder.

5. An embroidery sewing machine according to claim 3, wherein the detecting element is fixed to the carriage.

6. An embroidery sewing machine according to claim 2, wherein the detecting element includes a rotary potentiometer having a detecting member brought into contact with one of the detected portions of the detected body.

7. An embroidery sewing machine according to claim 2, wherein the detected portions of the detected body have heights or widths differing from each other along a direction in which the movable holder is moved respectively.

8. An embroidery sewing machine according to claim 2, wherein each detected portion of the detected body includes a tapered face having a height or a width changing therealong.

9. An embroidery sewing machine according to claim 2, wherein the holder body includes a guide mechanism guiding the movable holder to one of the positions by sliding movement and a positioning mechanism positioning the movable holder at the one of the positions.

10. An embroidery sewing machine according to claim 9, wherein the holder body includes a fixing mechanism fixing the movable holder positioned by the positioning mechanism to the holder body.

11. An embroidery sewing machine according to claim 9, wherein the positions at which the movable holder is positioned by the positioning mechanism correspond to the detected portions of the detected body respectively.

12. An embroidery sewing machine according to claim 11, wherein the detected portions of the detected body have heights or widths differing from each other along a direction in which the movable holder is moved respectively.

13. An embroidery sewing machine according to claim 11, wherein each detected portion of the detected body includes a tapered face having a height or a width changing therealong.

14. An embroidery sewing machine according to claim 1, wherein each embroidery frame has both sides opposite to each other, and the frame holder is formed generally into a C-shape and includes a body fixed to the carriage and extending in one direction, the body of the frame holder having both ends, and two arms extending substantially perpendicularly from the ends of the body to support both sides of the embroidery frame respectively, and wherein the holder body of the frame holder includes said body and either one of said arms, and the movable holder includes the other arm mounted thereon so as to be displaceable relative to the body of the frame holder.

15. An embroidery sewing machine according to claim 1, wherein each embroidery frame has both sides opposite to each other, and the frame holder is formed generally into a C-shape and includes a body fixed to the carriage and extending in one direction, the body of the frame holder having both ends, and two arms extending substantially perpendicularly from the ends of the body to support both sides of the embroidery frame respectively, and wherein the holder body of the frame holder includes said body and the movable holder includes said arms mounted thereon so as to be displaceable relative to the body of the frame holder.

* * * * *